United States Patent [19]

Rosenberg et al.

[11] 4,186,450

[45] Feb. 5, 1980

[54] BIDET ARRANGEMENT

[75] Inventors: Ralf H. S. Rosenberg; Morgan H. O. Ferm, both of Göthenburg, Sweden

[73] Assignee: IFO Sanitar AB, Bromolla, Sweden

[21] Appl. No.: 945,714

[22] Filed: Sep. 25, 1978

[30] Foreign Application Priority Data

Sep. 28, 1977 [SE] Sweden ..... 7710824

[51] Int. Cl.[2] ..... A47K 3/22

[52] U.S. Cl. ..... 4/6; 4/7; 4/240

[58] Field of Search ..... 4/6, 7, 145, 237, 234, 4/236, 240, 177; 297/14, 349

[56] References Cited

U.S. PATENT DOCUMENTS

| | | | |
|---|---|---|---|
| 1,197,657 | 9/1916 | Orofino | 4/6 |
| 1,617,901 | 2/1927 | Freise | 297/14 |
| 1,642,125 | 9/1927 | Nelson | 297/14 |
| 2,715,736 | 8/1955 | Pearlson | 4/177 |
| 3,275,283 | 9/1966 | Rauch | 297/349 |
| 3,979,096 | 9/1976 | Zieger | 4/145 |

*Primary Examiner*—Lenard A. Footland

*Attorney, Agent, or Firm*—Sughrue, Rothwell, Mion, Zinn & Macpeak

[57] ABSTRACT

The invention relates to a bidet arrangement for restrooms and solves most of the problems experienced by disabled persons wishing to visit a restroom without having to be assisted by another person. The bidet is of the type having no bowl, the water being instead supplied from a hand shower nozzle. According to the invention the seat (3) of the bidet is swingable between a horizontal position, in which the bidet function may be performed, and a vertical position in which a member (8) carried by the seat may serve as a support for a standing person. The arrangement also includes means (4, 5) protecting the seat from unintentionally leaving its vertical position.

4 Claims, 4 Drawing Figures

BIDET ARRANGEMENT

The present invention relates to an arrangement which can be used both as a bidet seat and as a support for a handicapped person when he is in a standing position or when he is moving from a sitting to a standing position or vice versa. The term "handicapped" as used here refers not only to disabled or crippled persons but also to old people. One most prominent problem which is common to those groups of people is the difficulty, without assistance from another individual, to visit a restroom for the purpose of using a toilet and/or a bidet or taking a shower. This difficulty is mainly due to the fact that conventional restrooms which are designed for healthy people have smooth, glossy wall surfaces. It is consequently very difficult, and in some cases completely impossible, for a disabled person visiting a restroom himself to switch from a standing to a sitting position. Also, the legs of a person normally sitting in a wheel-chair are often so weakened or crippled that they cannot at all, or only with great pain, be exposed to the full weight of the person when in a standing position. There does thus also exist a need for a device allowing such a person partly to deload the legs when standing up for a shorter or longer while.

It should be noted that it is for two major reasons desirable that handicapped persons should have the possibility without any assistance to visit a restroom to perform the above-mentioned functions. One of those reasons is that a considerable number of them are forced to be hospitalized just because they are unable at home to take care of their personal hygiene. The main reason is, however, the natural desire for privacy in connection with a restroom visit. It should also be observed that very old people, like people normally sitting in a wheel-chair, often suffer from diseases which either limit the maximum physical stress to which they can safely expose themselves or significantly increase the need of cleaning after use of a toilet.

The main object of the invention is to provide a device representing a big step towards the complete and final solution of the problems above discussed. Further objects of the invention are to provide a device which is of simple design and cheap in manufacture, convenient to use and easily can be installed in existing restrooms. Finally, another object of the invention is to provide a device of the type discussed which is very compact and thus occupies just a small space.

The device covered by this patent is a bidet arrangement of the type having a seat which is supported by a wall of a restroom and swingable between an upper, vertical, position and a lower, horizontal, position. In the latter position of the seat the bidet function of the arrangement can be performed by insertion of a hand shower nozzle into the space below a central opening in the seat. According to the main characteristic of the invention the seat is provided with a member which in the upper position of the seat is substantially perpendicular to the plane thereof and provides an essentially horizontal support surface capable of absorbing part of the body weight of a standing person. The arrangement does also include means which automatically lock the seat in its upper position, thereby providing protection against unintentional swinging of the seat down to its horizontal position.

One embodiment of the invention will now be described in greater detail, reference being made to the accompanying drawing.

Figure 1:
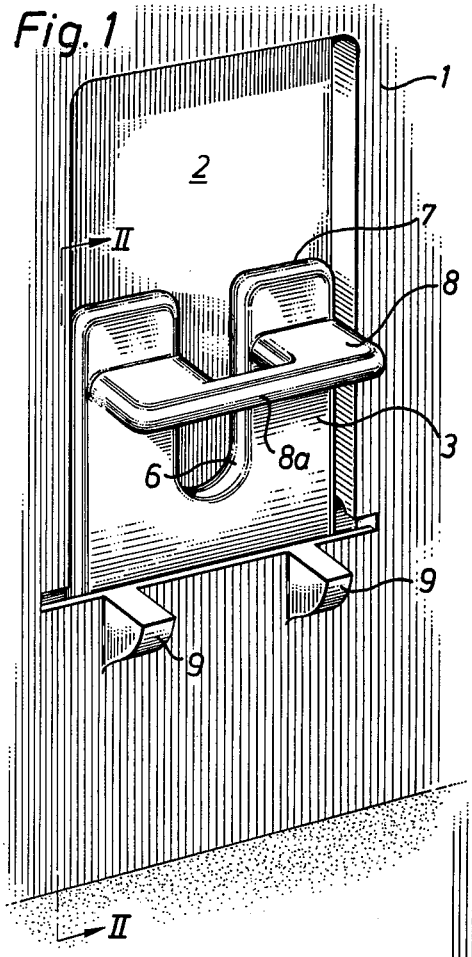
FIG. 1 is a perspective view showing a portion of a restroom wall having a bidet seat designed according to the invention and shown in its upper position.
Figure 3:
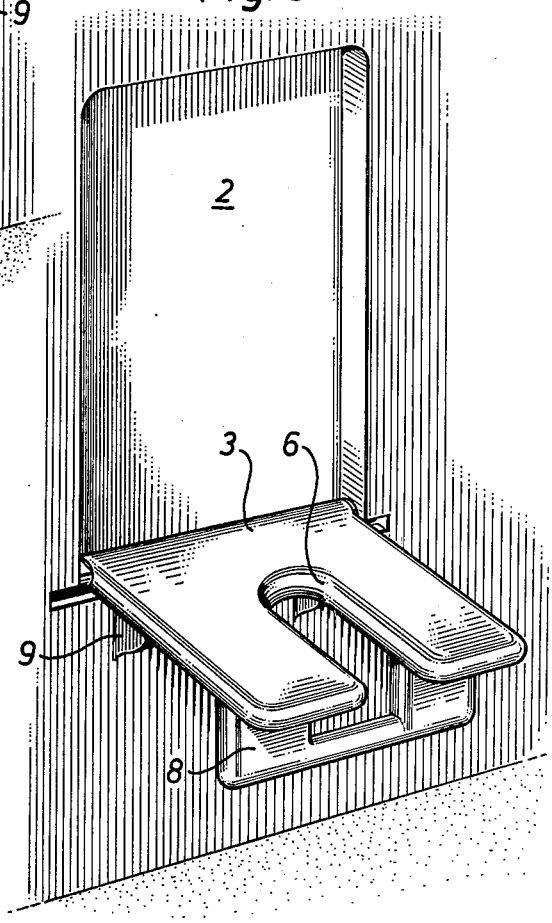

FIG. 3 corresponds to FIG. 1 but shows the bidet seat in its lower, horizontal position.

Figure 4:
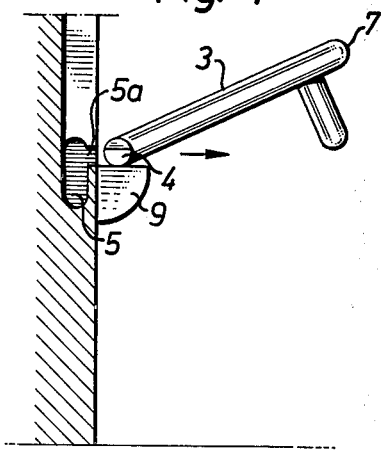

FIG. 4 is a side elevation showing the bidet seat in an intermediate angular position in which it can easily be mounted on the wall or removed therefrom.

Figure 2:
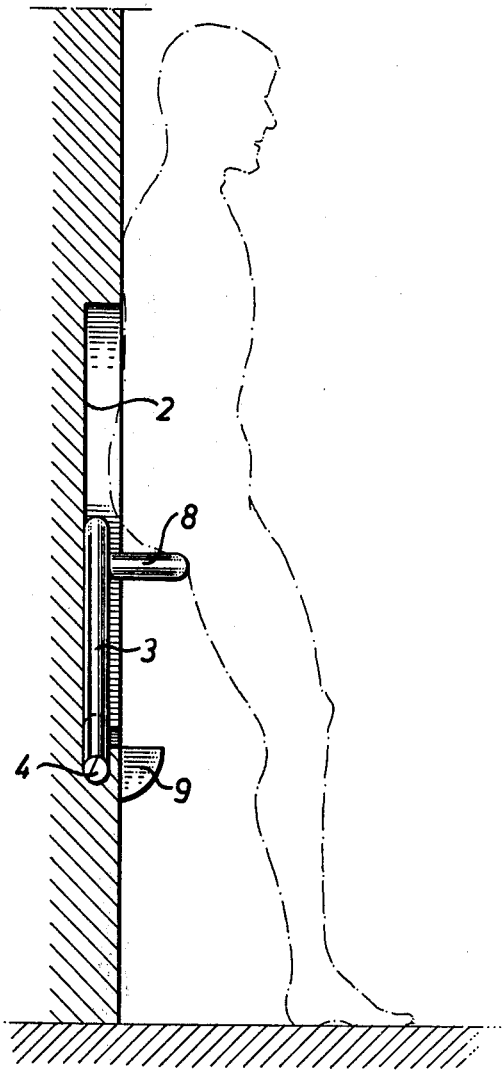
FIG. 2 is an elevational view illustrating the way in which the arrangement can perform its supporting function.

Reference numeral 1 designates a portion of a wall in a restroom, a shower room or the like, which is equipped with a hand shower. In wall 1 there is a niche 2 the contour line of which is substantially rectangular. In the lower portion of the niche there is a seat 3 which, according to the embodiment here shown, is substantially square. In FIGS. 1 and 2 the major portion of the seat is received inside niche 2. Adjacent to its lower edge seat 3 has two pivots 4 received in a groove 5 in the wall. As appears from FIG. 4, groove 5 has a considerably greater height than the diameter of pivots 4. This means that when seat 3 is swung to its vertical position as shown in FIGS. 1 and 4 the front surface of the lower edge portion of seat 3 engages the front portion of the wall of groove 5 so that the seat cannot be swung outwards and downwards until having first been lifted upwards. As is understood, this arrangement protects the seat from being unintentionally swung downwards. The practical significance of that protection will be dealt with below.

As is seen from FIGS. 1 and 3, the square seat plate 3 has a central opening 6 extending from its front edge 7 to a point about $\frac{3}{4}$ of the distance to the rear edge of the seat. According to the embodiment illustrated the width of opening 6 is roughly the same as the width of each of the seat portions laterally of opening 6.

Extending from the side of seat plate 3 which, in the vertical position of the seat, is facing the interior of the room is a member 8 substantially shaped like a U having wide legs and a web portion 8*a* of circular cross-section. Member 8 performs two functions. It forms a shelf-like support which allows a person standing with his back facing wall 1 to assume a semi-sitting position as illustrated in FIG. 2. The corresponding deloading of the legs from a substantial portion of the body weight makes it possible also for persons having very weakened legs for a considerable time to remain in the upright position shown in FIG. 2. The other function of member 8 is that its web portion may serve as a handle giving support to a standing person who grasps the handle with one hand holding the related arm directed downwards. As was mentioned above, the protection against unintentional downward swinging of seat 3 is of great practical significance. One advantage is that a downwards directed pressure on member 8 causes a torque tending to swing the seat plate as just said. Another important advantage is that member 8 can also absorb forces directed outwardly from wall 1. This makes it possible for a person who has fallen on the floor to use the handle when he shall again rise.

When seat 3 is in its horizontal position as shown in FIG. 3, it forms the seat of a bidet. The bidet function is exerted by means of the nozzle of a hand shower (not shown). Thanks to the absence of a bidet bowl the nozzle can be introduced into the space below seat 3 both from the front and from both sides. This greatly facilitates the corresponding washing operation, especially for heavily disabled persons.

As has already been mentioned, when seat 3 is to be swung downwards, it must first by means of handle 8 be lifted so that pivots 4 will contact the upper walls of groove 5—see FIG. 3. When in its horizontal position seat 3 rests against two shoulders 9 projecting from wall 1. The advantage of making niche 2 higher than what is necessary to accomodate seat 3 when in its vertical position is that a person sitting on the seat when in its horizontal position will not come into contact with any sharp wall edges or corners.

According to a preferred embodiment of the invention the wall defining the groove has in front of each of pivots 4 an opening 5*a*, the height of which is less than the diameter of the pivot shaft 4. However, pivots 4 are bevelled so that they can pass through opening 5*a* when seat 3 is in the angular position illustrated in FIG. 4. Thanks to this design seat 3 may conveniently be mounted and demounted while being at the same time protected from an unintentional removal.

It is self-evident that the relative dimensions and proportions illustrated on the drawings relate just to the embodiment selected and that the corresponding parameters may vary within wide limits. By way of example, there is no need for seat 3 to be shaped like a square plate. Instead, the only requirement is that it has such a configuration that it may in its horizontal position act as a seat and in its vertical position form a support which can be used in the manner above described. Also, the relative size of opening 6 can be quite different from what has been shown on the drawing. In the one limit case seat 3 can be constituted by a U-shaped or closed frame the supporting surface area of which is much less than in the embodiment here shown. Member 8 may also have several different forms. The advantage of the shape here illustrated is that it also provides a reinforcement of the seat proper and that it can be formed integrally with the seat, e.g. by a moulding operation. Shoulders 9 may be replaced by any other suitable supporting means.

What is claimed is:

1. A bidet arrangement, comprising a seat which is supported by a wall of a restroom and swingable between an upper, vertical, position and a lower, horizontal, position in which the bidet function can be performed by the insertion of a hand shower nozzle into the space below a central opening in the seat, characterized in that a member (8), substantially perpendicular to the plane of the seat, in the upper position of the latter provides a horizontal support surface capable of absorbing part of the body weight of a standing person, means being provided to lock the seat in its upper position when it is used to support a standing person.

2. A bidet arrangement according to claim 1, characterized in that member (8) bridges the opening (6) and preferably is integral with the seat, e.g. moulded in one piece.

3. A bidet arrangement according to claim 1 or 2 and mounted on a wall (1) having a niche-shaped recess (2), characterized in that the seat is received by the recess when in its upper, vertical position.

4. A bidet arrangement according to claims 1 or 2, characterized in that the seat is swingable around pivots (4) received in grooves (5) which are oblong in the vertical direction so that, when the seat is in its vertical position and the pivots rest against the bottoms of the grooves, the front of the lower edge portion of the seat engages the front walls of the grooves thereby locking the seat against being unintentionally swung downwards.

* * * * *